US010962268B1

(12) United States Patent
Ramsay

(10) Patent No.: US 10,962,268 B1
(45) Date of Patent: Mar. 30, 2021

(54) OUTDOOR HEAT EXCHANGER AIR DEFLECTOR

(71) Applicant: Mark D. Ramsay, Marriottsville, MD (US)

(72) Inventor: Mark D. Ramsay, Marriottsville, MD (US)

(73) Assignee: EFFECTIVE PROJECT SOLUTIONS LLC, Mariottsville, MD (US)

( * ) Notice: Subject to any disclaimer, the term of this patent is extended or adjusted under 35 U.S.C. 154(b) by 0 days.

(21) Appl. No.: 16/993,819

(22) Filed: Aug. 14, 2020

(51) Int. Cl.

| | |
|---|---|
| ***F24F 1/50*** | (2011.01) |
| ***F25B 49/02*** | (2006.01) |
| ***F24F 13/08*** | (2006.01) |
| ***F24F 11/46*** | (2018.01) |

(52) U.S. Cl.
CPC ..... *F25B 49/02* (2013.01); *F24F 1/50* (2013.01); *F24F 11/46* (2018.01); *F24F 13/08* (2013.01)

(58) Field of Classification Search
CPC ..... F24F 1/50; F24F 1/56; F24F 1/58
See application file for complete search history.

(56) References Cited

U.S. PATENT DOCUMENTS 2,920,464 A * 1/1960 Trask ..... F24F 1/56 62/428
4,723,419 A * 2/1988 Kessler ..... F24F 1/38 165/145
4,815,530 A * 3/1989 Scott ..... F24F 13/20 165/134.1
5,158,486 A * 10/1992 Tamame ..... F24F 13/20 160/368.1
5,529,092 A * 6/1996 Arnoldt ..... F15D 1/04 137/561 A
5,927,339 A * 7/1999 Ellis ..... F24F 13/081 138/37
10,294,684 B1 * 5/2019 Shedd ..... E04B 1/19
(Continued)

FOREIGN PATENT DOCUMENTS

KR 101500693 B1 * 3/2015 ..... F24F 1/58

OTHER PUBLICATIONS

Surbevski, Goran. "Everything You Need to Know About Air Conditioner Air Deflectors." Alliance Climate Control, Sep. 18, 2018, www.alliancecc.com.au/everything-you-need-to-know-about-air-conditioner-air-deflectors/. (Year: 2018).*
(Continued)

*Primary Examiner* — Jonathan Bradford

(57) ABSTRACT

The purpose of the invention is to reduce power consumption of heat exchangers (otherwise known as condensers or outdoor heat pump units) used for residential or building air conditioning and/or heating. The invention is a set of thin deflector(s) that attach to the top of the unit. The deflectors redirect air that the unit discharges vertically to a horizontal or slightly higher direction. This reduces recirculation of exhaust air to the intake when structural surfaces are close to the exchanger. Less recirculation reduces power consumption and thereby electric bills and allows the cooling and/or heating system to operate closer to capacity in ambient temperature extremes. It also could extend the life of the compressor's electrical insulation by allowing it to operate at lower temperature.

2 Claims, 2 Drawing Sheets

Elevation

Plan

(56) References Cited

U.S. PATENT DOCUMENTS

| | | | | |
|---|---|---|---|---|
| 10,337,756 | B2 * | 7/2019 | Han | F24F 13/15 |
| 10,670,281 | B2 * | 6/2020 | Jones | F24F 1/58 |
| 2007/0266854 | A1 * | 11/2007 | Scherrer | B01D 45/06 95/267 |
| 2014/0260363 | A1 * | 9/2014 | Bush | F24F 1/56 62/81 |
| 2017/0089628 | A1 * | 3/2017 | Jang | F24F 1/0011 |
| 2018/0299143 | A1 * | 10/2018 | Yamada | F24F 13/14 |

OTHER PUBLICATIONS

Kuzmanovski, Michael. "What's an Air Conditioning Deflector? How Much Does It Cost?" Alliance Climate Control, Mar. 7, 2020, www.alliancecc.com.au/whats-an-air-conditioning-deflector-how-much-does-it-cost/. (Year: 2020).*

* cited by examiner

Situation that it Addresses

Explanation: This is the situation before the invention is installed. The nearby structure and overhead structure cause a percentage of upward discharge air to recirculate to the inlet. This is confirmed by actual temperature measurement. Inlets are on all four faces of the Exchanger.

Elevation

Plan

OUTDOOR HEAT EXCHANGER AIR DEFLECTOR

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO SEQUENCE LISTING, A TABLE OR A CD APPENDIX

Please see "INVENTOR'S PRIOR ART SEARCH," referenced in "18. Other" on the Patent Application Transmittal.

BACKGROUND OF THE INVENTION

Many dwellings have outdoor heat exchangers, purposed for HVAC refrigerant condensing or, in the case of heat pumps, both condensing and evaporation. Many dwellings have erected decks above the exchangers, and even though the decks are installed five feet or more above according to exchangers manufacturers' recommendations, inventor discovered that some discharge air after being blown upward impinges upon the deck then moves horizontally then down an exterior wall of the dwelling. After it moves down, some of it gets drawn back into the exchanger intake. This increases intake air temperature to the exchanger which reduces power efficiency. The exchanger must draw more power to compensate for the recirculation. And the exchanger reaches capacity at temperatures more moderate than the extremes for which they it was designed. Owners will want to abate the power increase to save money.

Temperature measurements on the inventor's domestic outdoor exchanger serving as a condensing unit used for whole-house air conditioning show that the intake air temperature is 4.2 degrees F. higher than a point 20 feet away from the dwelling. This is because a deck is six feet above the top of the condenser, and the condenser is surrounded by two exterior house walls. A study found at: https://www.energy.gov/sites/prod/files/2015/10/f27/bto_pub59157_101515.pdf p. xviii, shows that a 4.2 F increase in intake air decreases condenser efficiency by 5.2%. The invention would eliminate practically all this efficiency decrease. That would save electrical energy. Heat pump outdoor units would show similar results in summer mode. Temperature observations would be reversed in winter mode.

Many households in the United States suffer from exchanger air recirculation. Over-55 living house plans north of the District of Columbia in hilly states have basements. My neighborhood has 240 units and 9% of them have decks over their exchangers, by inspection. Assuming 55-older developments across the U.S have 200 units and counting all these developments in hilly and more northern states (where decks over exchangers are architecturally possible), the number of households that could benefit from this invention number over 21,000. Now, single family dwellings could also have decks over their exchangers. Assuming 1% of single-family households of any type do, then 950,000 could benefit. In fact, my last single-family detached house had a deck over the exchanger.

BRIEF SUMMARY OF THE INVENTION

The invention is a set of fixed deflectors that are positioned above the exchanger's discharge fan. The deflectors redirect discharge air horizontally in a chosen azimuthal direction, thereby blowing the discharge out from under the deck or more broadly an overhead structure. This greatly reduces the discharge from getting drawn back into the exchanger intake. The invention can be either an after-market item or part of original equipment manufacture.

BRIEF DESCRIPTION OF THE SEVERAL VIEWS OF THE DRAWING

See "Exchanger Air Deflector" diagram—FIG. 1 to show the problem that this invention addresses. The text of this application describes the problem as well, but a diagram always improves understanding.

Figure 1:
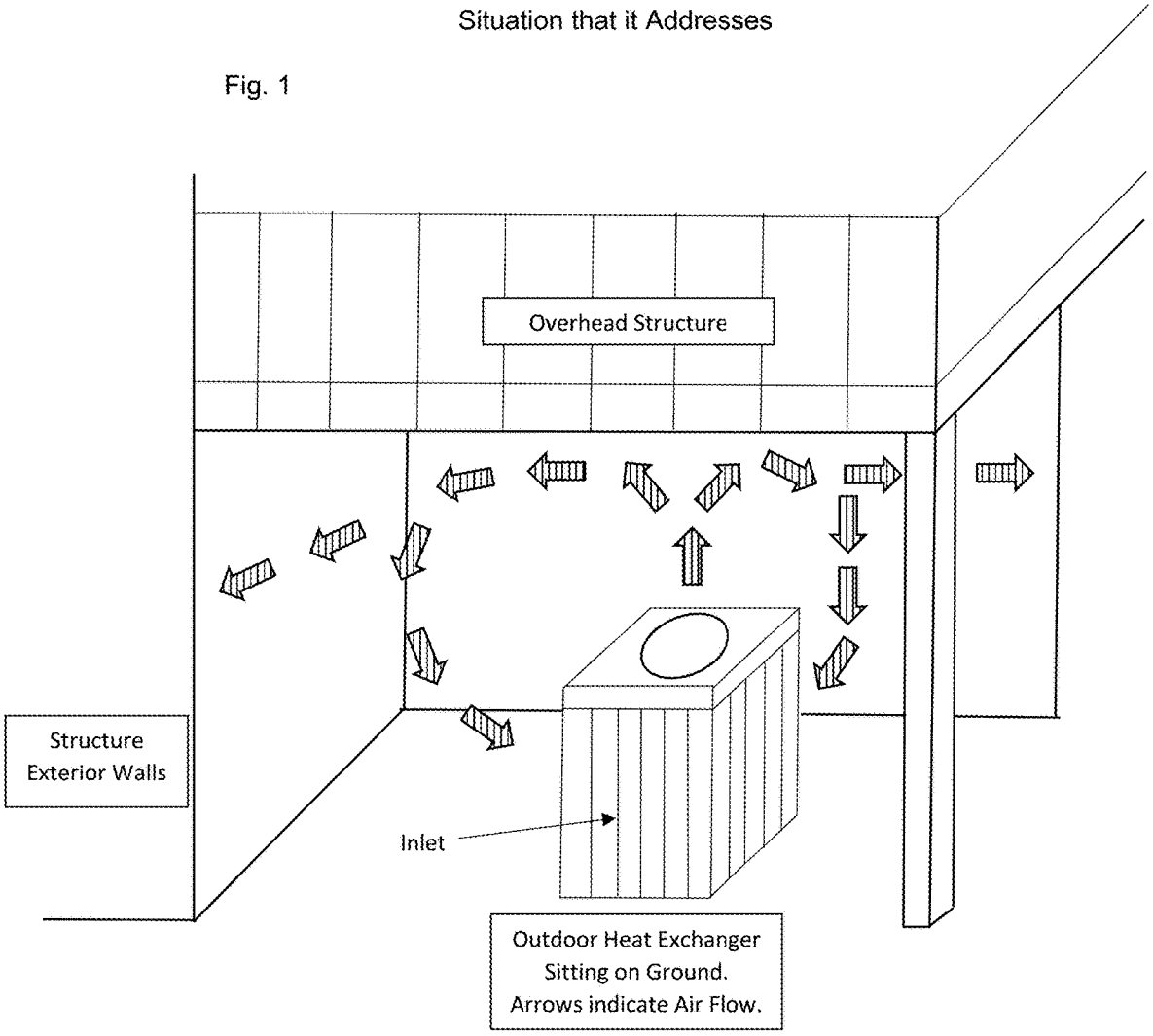
FIG. 1 is not illustrating the invention.
Figure 2:
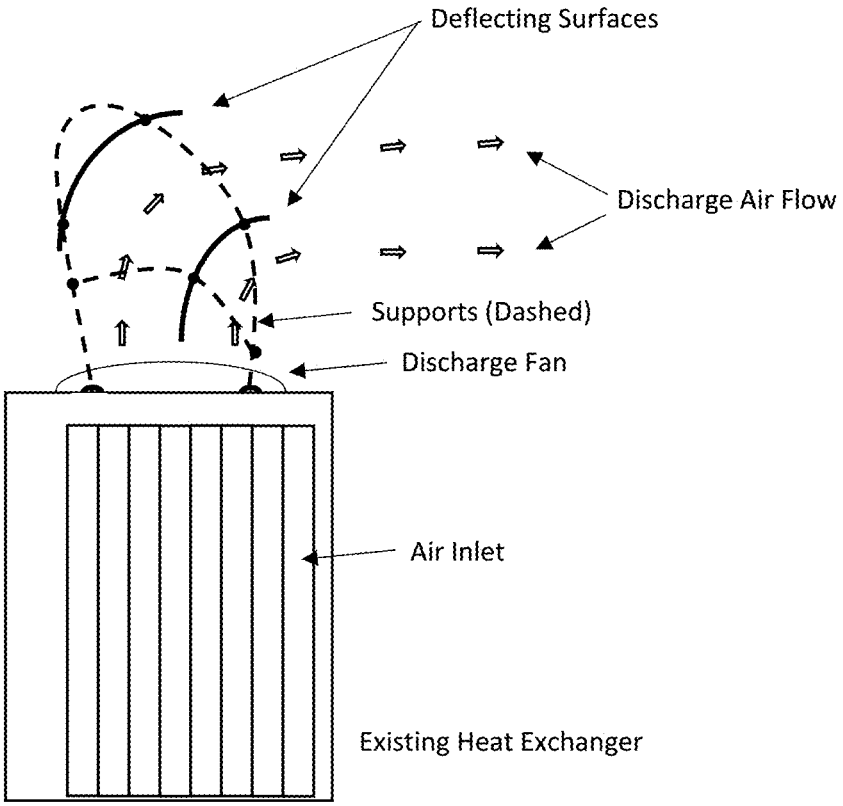
Figure 2:
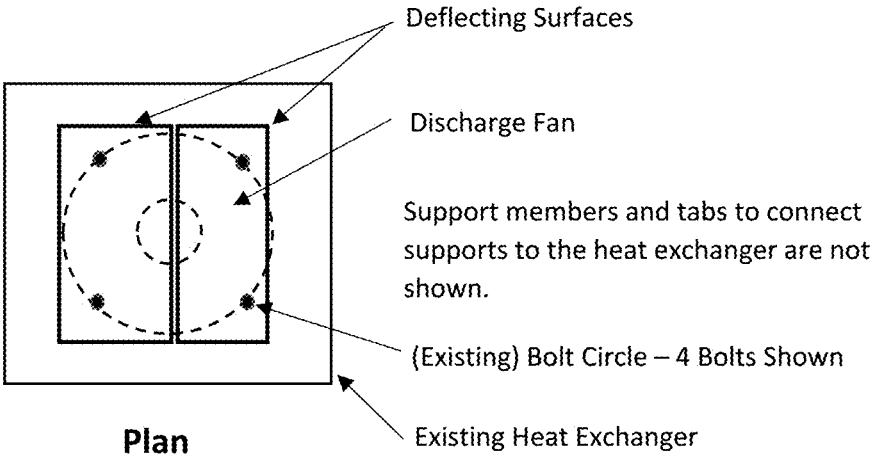

See "Exchanger Air Deflector" diagram—FIG. 2, showing an elevation and a plan of the invention mounted to an exchanger. The exchanger sits on a pad on the earth. The diagram shows curved surfaces for deflectors, but they need not be curved.

DETAILED DESCRIPTION OF THE INVENTION

The invention is made of several hard surfaces that start their deflection vertically above the unit, then end in a horizontal direction or direction slightly above horizontal. The surfaces would span nearly the width of the exchanger. The highest surface would apex about two feet above the unit. The surfaces would be supported by a framework that attaches to the exchanger using tabs that engage the exchanger fan's bolt circle or perimeter. The surfaces would direct exhausted air to a single azimuthal direction. The user would mount the invention to direct air azimuthally to the shortest path out from under the overhead structure's projection. Suitable construction materials would be metal and plastic. No utilities or fluids are needed.

Alternatively, the hard surfaces could be decorative. Curved surfaces in the shape of a huge leaf would be more attractive for customers wanting a more natural-like appearance. Curved surfaces also reduce back pressure on the heat exchanger fan. Notwithstanding, this invention is Utility.

The invention claimed is:

1. A set of turning vanes for increasing electrical efficiency of an upward-air-flow outdoor heat exchanger used in an HVAC system, comprising:

one or more curved deflecting surfaces configured to be suspended directly above a discharge of the exchanger;

supports that are configured to fasten and hold the deflecting surfaces in position, wherein at least one of said supports is configured to mount to the exchanger; and fastened joints that are configured to fasten the deflecting surfaces, supports, and exchanger together;

wherein the deflecting surfaces are not enclosed and are open to outdoor air.

2. A method to increase electrical efficiency of an upward-air-flow outdoor heat exchanger used in an HVAC system and equipped with a set of non-enclosed turning vanes at a discharge of the heat exchanger, the method comprising:

redirecting discharge air of the exchanger in approximately a horizontal direction;

redirecting the discharge air to a single azimuthal direction;

minimizing back pressure on the discharge of the exchanger;

maintaining momentum of the discharge air; and preventing widening of the discharge air plume in order to maintain air velocity.

* * * * *